United States Patent [19]

Gerlach et al.

[11] Patent Number: 4,659,344

[45] Date of Patent: Apr. 21, 1987

[54] LIQUID MOTOR AND PUMP WITH A STROKE REGULATING GAS MOTOR

[76] Inventors: Charles R. Gerlach, 639 W. Rhapsody, Sand Antonio, Tex. 78216; Rodney T. Heath, 4901 E. Main, Farmington, N. Mex. 87401

[21] Appl. No.: 513,637

[22] Filed: Jul. 14, 1983

Related U.S. Application Data

[62] Division of Ser. No. 277,266, Jun. 25, 1981, Pat. No. 4,402,652.

[51] Int. Cl.[4] ..... B01D 53/26

[52] U.S. Cl. ..... 55/29; 55/208; 91/164; 91/313; 417/404

[58] Field of Search ..... 55/29–32, 55/208; 91/164, 224, 226, 313, 321, 342; 417/404

[56] References Cited

U.S. PATENT DOCUMENTS

| | | | |
|---|---|---|---|
| 3,094,574 | 6/1963 | Glasgow et al. | 55/32 X |
| 3,105,748 | 10/1963 | Stahl | 55/32 |
| 3,288,448 | 11/1966 | Patterson et al. | 55/32 X |
| 3,331,188 | 7/1967 | Sinex | 55/31 |
| 3,492,787 | 2/1970 | McMinn | 55/31 |
| 3,541,763 | 11/1970 | Heath | 55/31 X |
| 4,286,929 | 9/1981 | Heath et al. | 417/404 |
| 4,342,572 | 8/1982 | Heath | 55/208 X |
| 4,402,652 | 9/1983 | Gerlach et al. | 417/404 |
| 4,431,433 | 2/1984 | Gerlach et al. | 417/404 X |

*Primary Examiner*—Robert Spitzer
*Attorney, Agent, or Firm*—Klaas & Law

[57] ABSTRACT

A liquid motor is driven by pressurized wet glycol, received from an absorber of a natural gas dehydrating system, and utilizes the energy of the pressurized wet glycol to provide the primary source of energy for operating a pump for pumping of dry glycol from a reboiler to the absorber. A gas driven motor regulates the stroking rate of the glycol driven motor. The liquid motor and pump each have a two stage double acting piston in cylinders with fluid intake and exhaust valving and passages to alternately fill and exhaust the motor cylinders while the opposing pump cylinders are simultaneously alternately filled and exhausted. A spool type valve rod, associated with the glycol driven motor, is operated by the gas driven motor to regulate the rate of reciprocation of the glycol driven motor and to provide a secondary source of energy therefor.

24 Claims, 11 Drawing Figures

LIQUID MOTOR AND PUMP WITH A STROKE REGULATING GAS MOTOR

This is a division of application Ser. No. 277,266, filed June 25, 1981, now U.S. Pat. No. 4,402,652.

BACKGROUND AND SUMMARY OF INVENTION

This invention relates to a fluid pumping system and, more particularly, to a fluid pumping system adapted for use with a natural gas dehydrating system of the type employed at a gas well head to remove water from a well stream composed of a mixture of gas, oil and water.

Examples of such gas dehydrating systems are disclosed in U.S. Pat. Nos. 3,094,574; 3,288,448; and 3,541,763; the disclosures of which are specifically incorporated herein by reference. In general, such systems comprise a separator means for receiving the gas-oil-water mixture from the well head and separating the oil and water liquids from "wet" (water vapor laden) gas; and a water absorber means, which employs a liquid dehydrating agent such as glycol, for removing the water vapor from the wet gas and producing "dry" gas suitable for commercial usage. The glycol is continuously supplied to the absorber means in a "dry" low water vapor pressure condition and is removed from the absorber means in a "wet" high water vapor pressure condition. The wet glycol is continuously removed from the absorber means and circulated through a reboiler means for removing the absorbed water from the glycol to provide a new supply of dry glycol. The glycol reboiler means usually comprises a still column associated with a gas burner for heating the wet glycol to produce hot dry glycol by removing the absorbed water by vaporization. The hot dry glycol passes through a heat exchanger, where the hot dry glycol is cooled and the incoming wet glycol is heated, to a dry glycol storage tank. A glycol passage means is provided to enable passage of wet glycol from the absorber means to the reboiler means and to pump dry glycol from the storage tank to the absorber means.

As described in our copending U.S. patent application, Ser. No. 36,839, filed May 7, 1979, the disclosure of which is hereby incorporated herein by reference, motors for glycol pumps of natural gas dehydrating systems have heretofore been designed to be operated by the energy of natural gas available at the well head due to the relatively high pressures and temperatures thereof. In addition, the energy of the wet glycol has been used to drive a single piston pump for the dry glycol as disclosed in U.S. Pat. No. 3,093,122 to Sachnik dated June 11, 1963. This pumping unit uses a fluid driven power piston, and a pilot valve driven by the same fluid controls the rate of operation of the master slide valve, which distributes fluid to the piston pump.

One of the problems with such prior pump designs is that the pressure of the gas stream from natural gas wells is highly variable and gas operated pumps often require large amounts of energy. Furthermore, changes in gas pressures during day to day operation have often caused stalling of the pump and interruption of the entire dehydrating system. Since the dehydrating systems are continuously operated at the well site without continuous monitoring by operating personnel, reliable continuous operation of the pump is of critical importance.

Another important performance factor is that the pump be self-regulating to automatically adjust the pumping rate in accordance with available gas pressure and flow rates. In addition, it is highly desirable to use energy sources available at the well site for operation of the pump with maximum efficiency and minimum energy loss Thus, an object of the present invention is to provide a new improved glycol pumping system which is operated by an available energy source other than the saleable dry natural gas at the well head.

Another object is to provide a new and improved pump which may be operated at relatively low speeds and pressures without stalling.

Another object is to provide a pumping system which is automatically continuously operable under a wide range of operating conditions.

Another object of the invention is to provide a combined fluid operable motor and fluid pump of the piston type, having a gas operated controller for controlling the rate of reciprocating movement of the pump motor.

Still another object of the invention is to utilize minimum quantities of gas for the control of a fluid motor.

Yet another object of the invention is to provide a highly efficient motor-pump arrangement using high pressure wet glycol to pump dry glycol in various systems.

An additional object of the invention is to utilize the control gas discharged from the control gas motor controller in operation of the reboiler burner.

The foregoing objects have been achieved by utilizing the energy available in the wet glycol as the primary motivating force to drive a new and improved dry glycol pump apparatus including an automatic speed control means operably by a wide range of pressurized natural gas which can also provide a secondary motivating force for the pump apparatus. The pump apparatus comprises a pump means for pumping dry glycol from the dry glycol tank to the absorber; a primary motor means for operation by high energy wet glycol received from the absorber and exhausting low energy wet glycol to the reboiler means; and a combination secondary motor means and speed control means operable by dry natural gas and exhausted to the reboiler burner means.

BRIEF DESCRIPTION OF DRAWING

The present invention is illustrated in the accompanying drawing wherein.

DETAILED DESCRIPTION

In General

Figure 10:
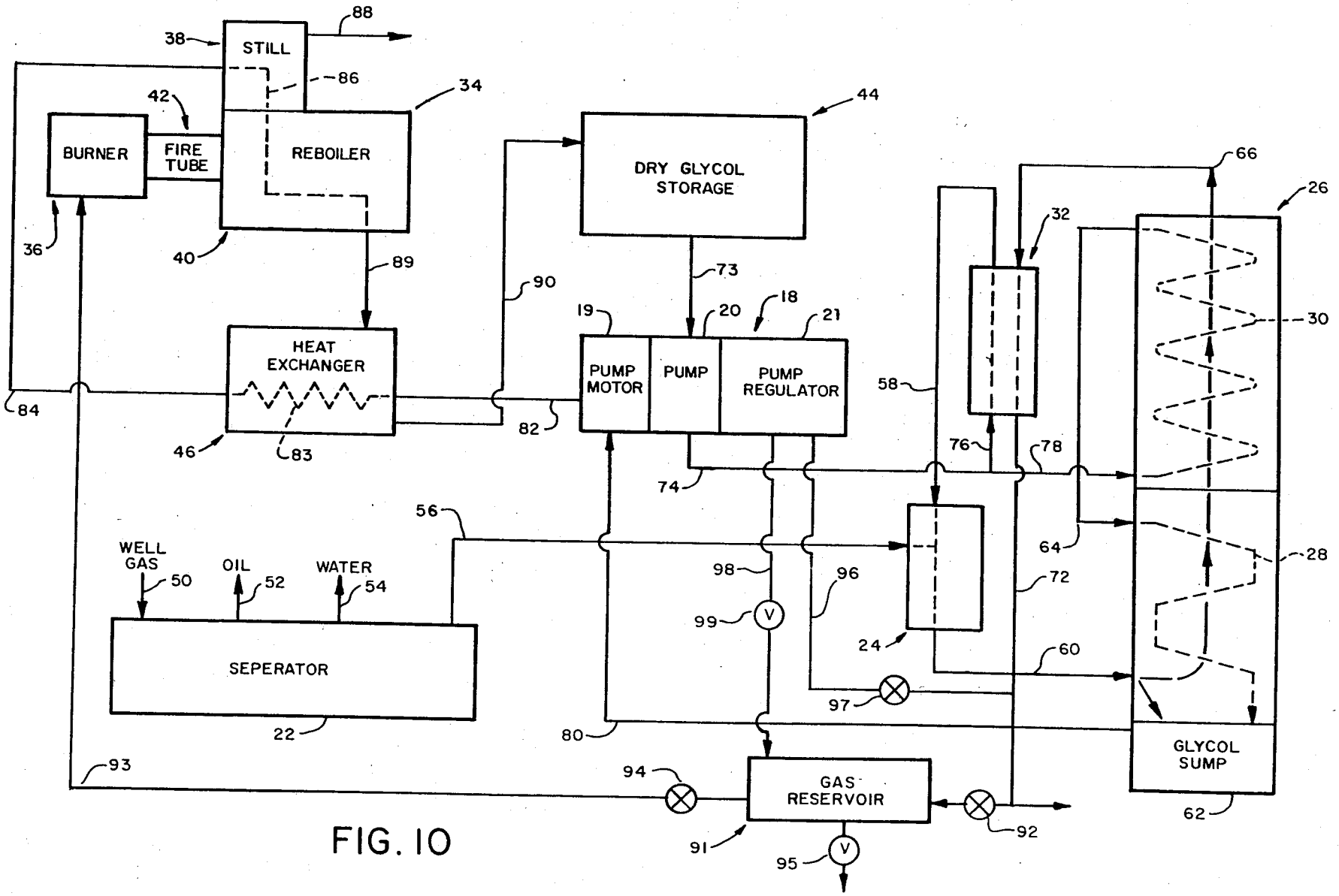
FIG. 10 is a schematic diagram of the pumping system in use in a natural gas dehydrating system.

Referring to FIG. 10, a pump means 18 of the present invention comprises a motor section 19, a pump section 20 and a regulator section 21 which are shown in association with the major components of a three-phased dual-contact conventional natural gas dehydration system comprising: a gas-liquid separator means 22 for removing oil and water liquids from water vapor laden well gas; a packed glycol-gas contactor means 24 for first stage removal of water vapor from the well gas by contacting the well gas with dry glycol during concurrent downward flow thereof; an absorber means 26 for second stage removal of water vapor from the well gas, including an internal tray stack means 28 for providing a downward gravity flow of dry glycol with upward counter flow of the well gas therethrough and an internal gas-glycol heat exchanger means 30 for cooling of dry glycol prior to entry of the dry glycol into the stack tray means 28; an external gas-glycol heat exchanger means 32 for cooling the dry glycol prior to entry into the glycol-gas contactor means; a glycol reboiler means 34 for removing water from the wet glycol, including a gas burner means 36 for heating the wet glycol, a still column means 38 for separating the water and the glycol by vaporizing the water, a tank means 40 for holding hot dry glycol, and a firetube means 42 in the tank means 40 for heating the hot dry glycol; a dry glycol storage tank means 44 for storing the dry glycol prior to return to the absorber means; and a glycol-glycol heat exchanger means 46 for cooling the hot dry glycol from the reboiler means before entry into the storage tank means while preheating the wet glycol from the absorber means before entry into the reboiler means.

Figure 1:
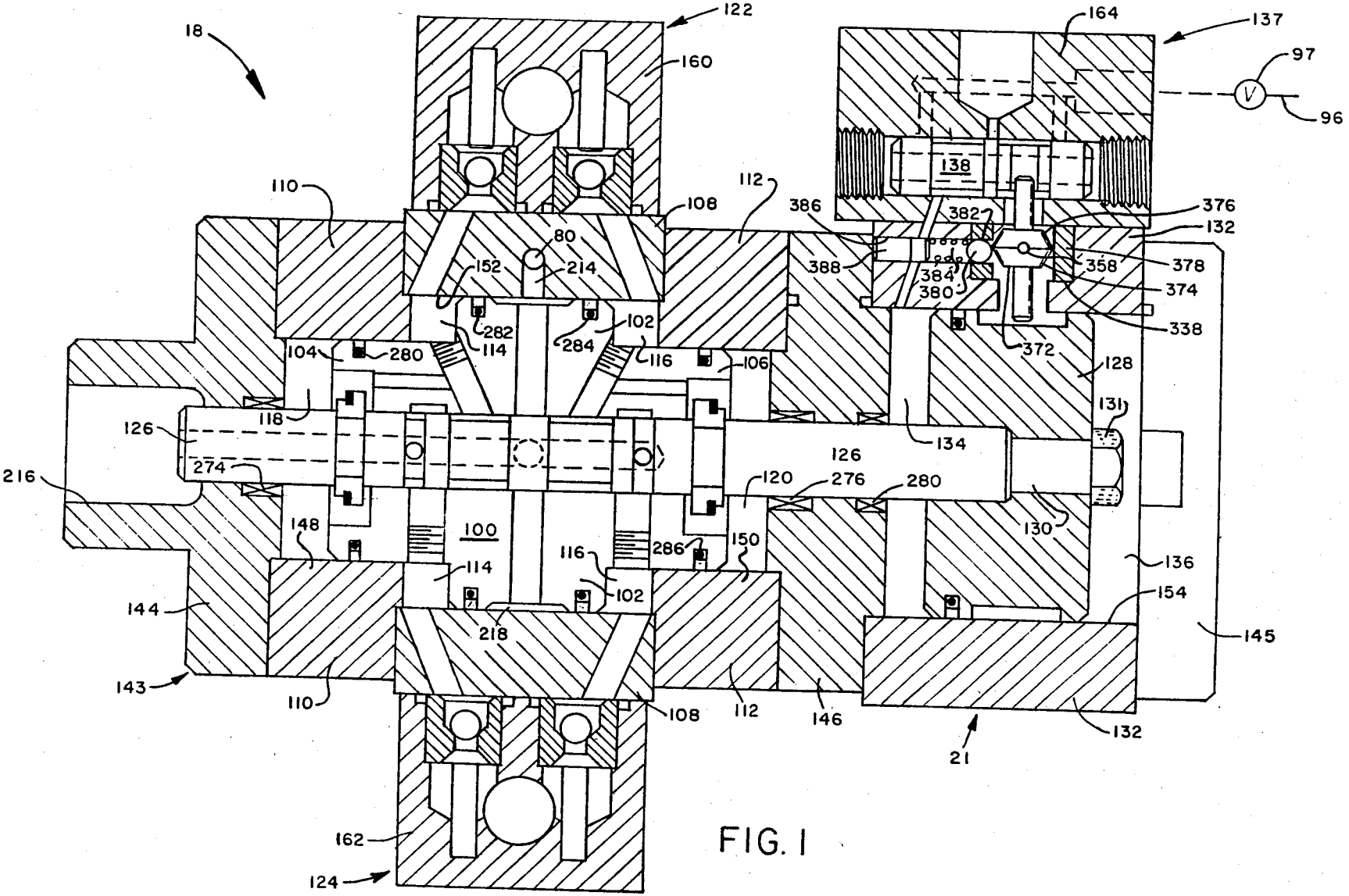
FIG. 1 is a cross-sectional side elevational view of an illustrative embodiment of the invention with some of the fixed parts displaced for purposes of illustration and with reciprocating piston parts of a pump portion and a motor portion and a regulating portion located in a central position relative to associated cylinder parts.

In operation of the system of FIG. 1, well gas under pressure enters separator means 22 through an inlet line 50. The well gas is separated into liquid oil, water and wet gas which includes the natural gas and water vapor. Liquid oil and water are removed from the separator through outlet lines 52, 54. Wet gas under pressure is transmitted through a line 56 to the packed glycol-gas contactor means 24 whereat dry glycol from a line 58 is mixed with the wet gas. The dry glycol and wet gas flow downwardly through contactor means 24 wherein the dry glycol absorbs a portion of the water vapor. Wet glycol and partially wet gas are removed from the contactor means through a line 60 which is connected to the lower end of absorber means 26 between a wet glycol sump 62 at the bottom of the absorber means and stacked tray means 28. Wet glycol from line 60 flows downwardly into the glycol sump 62. Wet gas flows upwardly in the absorber through the stacked tray means 28 which provides a downward flow path for dry glycol received from line 64 to the glycol sump. In this manner, additional amounts of water vapor are removed from the gas which then flows upwardly through heat exchanger means 30 to an outlet line 66 and then downwardly through heat exchanger means 32 to a pipeline 72 which contains dry saleable natural gas at relative high pressures of, for example, 50 psi to 1000 psi. The dry glycol is delivered from storage means 44 to the packed gas-glycol contactor means 24 and the absorber means 26 under pressure through a pump inlet line 73, pump 20, a main pump outlet line 74, branch lines 76, 78 extending through heat exchangers 30, 32, respectively, and inlet lines 58, 64. Wet glycol is exhausted from the glycol sump 62 to pump motor 19 through a line 80 and delivered to the still column 38 of reboiler means 34 through a line 82, glycol-glycol heat exchanger means 46, and a line 84. Wet glycol flows downwardly in the still column means 38 toward reboiler tank means 40 as indicated by dashed line 86. The water in the glycol is vaporized by heat obtained from gas burner means 36 through firetube means 42 which extends into the tank means 40. Vaporized water in the form of steam is removed from the upper end of still column means 38 through an outlet line 88. Hot dry glycol is collected in tank means 40, flows downwardly through a line 89 into the top of heat exchanger means 46 containing glycol heating coil means 83. Cool dry glycol is transmitted from the bottom of the heat exchanger tank to the upper portion of dry glycol storage means 44 through a line 90. A gas reservoir means 91 is connected to dry gas line 72 by a regulator means 92 which maintains a supply of relatively low pressure (e.g. 20 psi) dry gas in reservoir means 91. Burner 36 is connected to reservoir 91 by a dry gas line 93 through a regulator means 94, which reduces the pressure of dry gas to approximately 10 psi. Gas reservoir 91 has a pressure relief valve 95 to control dry gas pressure therein. Pump regulator and secondary motor means 21 is operated by dry gas received through a line 96 connected to outlet line 72 through a regulator means 97 which reduces the dry gas pressure to approximately 50 to 70 psi. Dry gas in pump regulator 21 is exhausted to reservoir 91 or burner 36 through a line 98 and an adjustable flow control valve means 99 by which the rate of operation (i.e. speed) of the pump 19 is controlled.

THE PUMP UNIT

In General

In general, as shown in FIG. 1, the motor and pump sections 19, 20 of the pump means unit 18 of the present invention comprise an integral one piece reciprocable piston means 100 having a relatively large diameter central fluid pump piston means portion 102 and oppositely extending relatively small diameter drive motor piston means portions 104, 106. A relatively large diameter cylinder means 108 freely reciprocably slidably supports central piston portion 102 and a pair of oppositely spaced cylinder means 110, 112 freely reciprocably slideable supports piston portions 104, 106. Variable volume pump chamber means 114, 116 are provided on opposite sides of the central piston pump portion and variable volume motor chamber means 118, 120 are provided opposite piston drive end portions 104, 106. Fluid flow control means 122, 124 control the flow of dry glycol fluid to and from pump chambers 114, 116. A fluid flow control means, in the form of a reciprocable spool type valve member 126 slidably centrally mounted in the piston means 100, controls the flow of wet glycol fluid to and from motor chambers 118, 120. The regulator section 21 of the pump means unit 18 comprises a piston means 128 connected to one end 130 of valve member 126 by a bolt 131 and freely reciprocably slidably mounted in a cylinder means 132 with variable volume fluid chambers 134, 136 on opposite sides thereof. A fluid flow control means 137, including reciprocable spool valve member 138 operably connected by toggle link means 142 to piston means 128, controls the flow of dry gas to and from chambers 134, 136.

The Pump Housing

The motor-pump-regulator sections 19, 20, 21 of the pump unit form an elongated multiple part cylindrical housing unit 143 having opposite end plates 144, 145, and separated into combined motor-pump housing sections 19, 20 and a regulator housing section 21 by a divider plate 146. The motor-pump housing sections 19, 20 comprise axially spaced cylindrical members 110, 112 having cylindrical bores 148, 150 and located on opposite sides of and in abutting supporting sealed engagement with central cylindrical member 108 having a cylindrical bore 152. Cylindrical members 110, 112 are mounted in fixed abutting supporting sealed engagement with end plate 144 and divider plate 146, respectively, by suitable bolt means (not shown). The regulator housing section 21 comprises cylindrical member 132 having a cylindrical bore 154 and being mounted in fixed abutting supporting sealed engagement between divider plate 146 and end plate 145 by the bolt means.

Flow control means 122, 124 comprise control valve block members 160, 162 suitably mounted in fixed abutting sealed relationship on support surfaces on the periphery of center cylindrical member 108. Fluid control means 137 comprises a control valve block member 164 mounted in fixed abutting sealed relationship with cylindrical member 132. Bores 148, 150, 152 and 154 are coaxial.

The Pump Section

Figure 6:
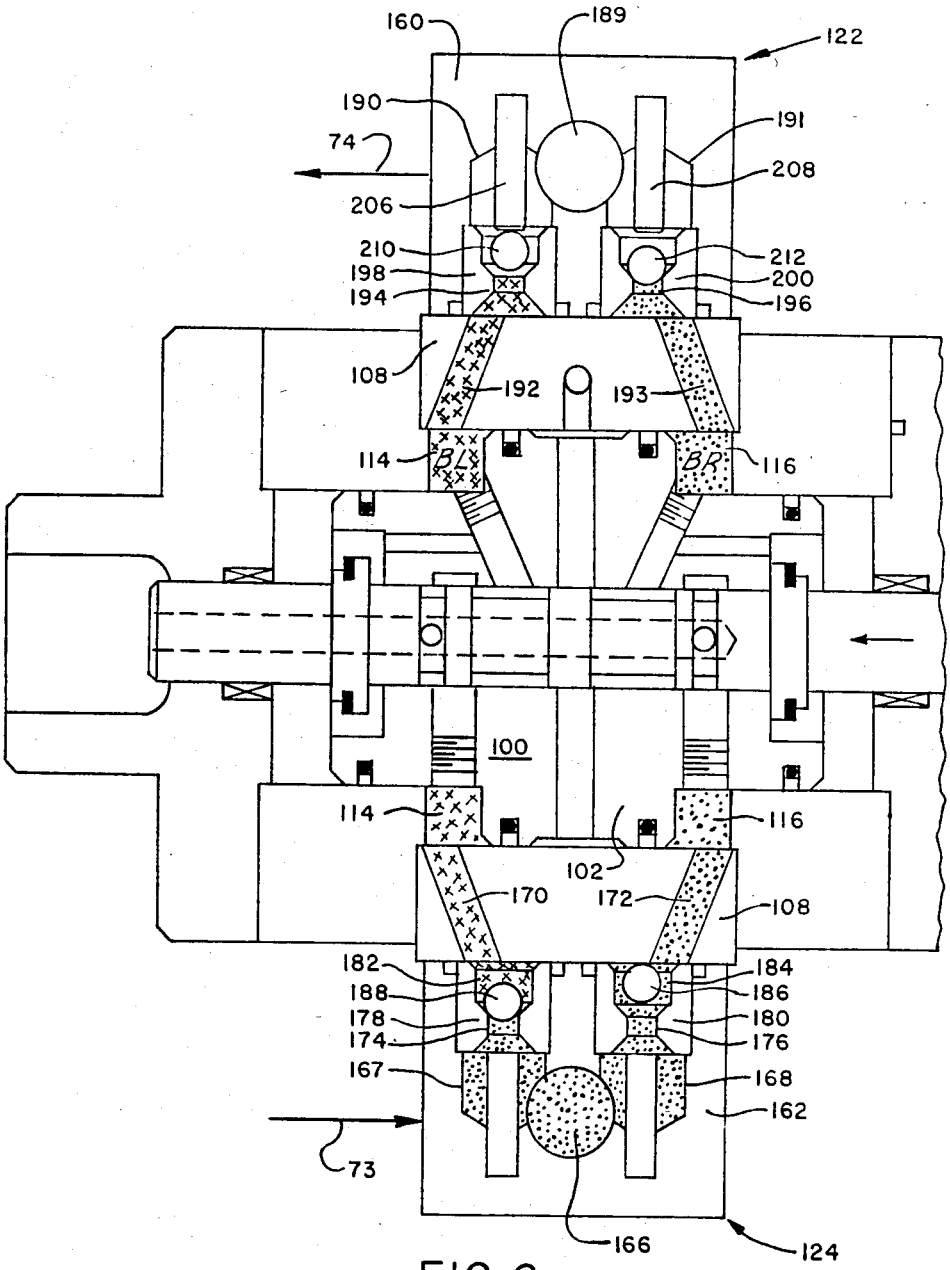
FIG. 6 is a simplified cross-sectional view of the pump and motor portions of the apparatus of FIG. 1.

Referring now to FIG. 6, pump chambers 114, 116 are connected to dry glycol inlet line 73 through valve means 124 by an inlet port 166 connected to chambers 167, 168, inlet passages 170, 172 in pump cylinder member 108, passages 174, 176 in check valve seat inserts 178, 180 mounted in parallel bores in valve block 162, and chambers 182, 184 in valve block 162. When piston means 100 moves to the left in FIG. 6, the volume of chamber 116 is increased and pressure is reduced whereby dry glycol opens check valve 186 to enable dry glycol to flow into chamber 116. At the same time, the volume of chamber 114 is decreased to increase the pressure of dry glycol in chamber 114 which forces ball valve 188 to the closed position as the piston means 100 moves to the left in FIG. 1. Pump chambers 114, 116 are also connected to the dry glycol outlet line 74 through valve means 122 by an outlet port 189 connected to chambers 190, 191, outlet passages 192, 193 in pump cylinder member 108, and passages 194, 196 in check valve seat inserts 198, 200 mounted in parallel bores in valve block 160. Chambers 190, 191 may include pin members 206, 208 to limit movement of ball-type check valves 210, 212. When the volume of chambers 114, 116 is reduced by movement of piston means 100, dry glycol is forced through the associated outlet passages 192 or 193 and causes the associated check valve 210 or 212 to open to enable flow into outlet passage 74. When the volume of chamber 114, 116 is increased, the chamber pressure is decreased whereby the ball valves 210, 212 are seated by the pressure differential between the dry glycol in chambers 90, 191 and the pump chambers 114, 116.

The Primary Motor Section

Figure 3:
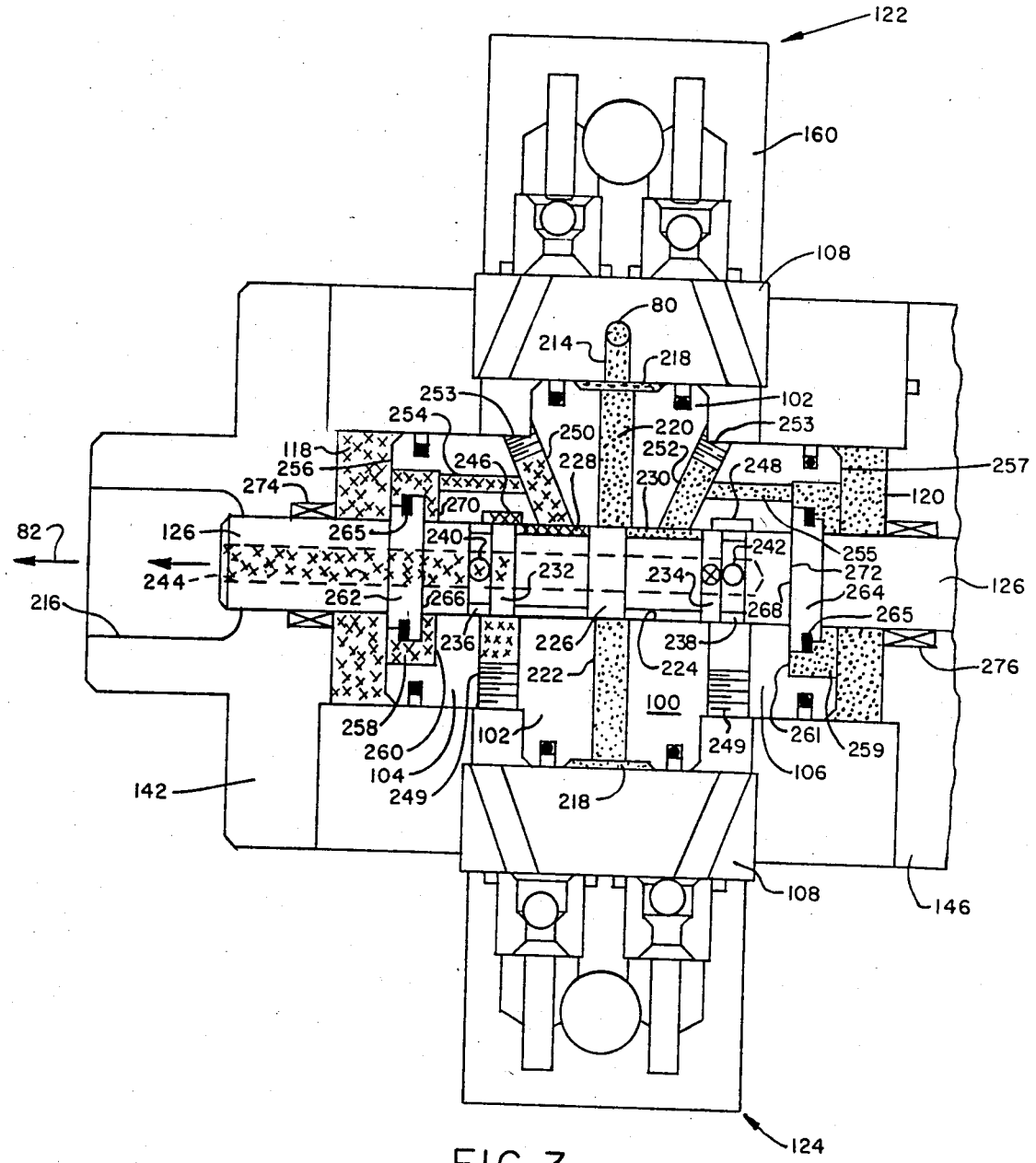
FIG. 3 is a cross-sectional side elevational view of a portion of the apparatus of FIG. 1 with the piston parts located in a leftward shifted position at the end of another pumping stroke.

Referring now to FIG. 3, the wet glycol inlet line 80 is connected to an inlet passage 214 in cylinder member 108 and wet glycol outline line 82 is connected to an outlet chamber 216 in end plate 142 to enable wet glycol to be alternately received in and discharged from motor chambers 118, 120 through intake and exhaust passage means in piston means 100 and valve spool member 126 as hereinafter described. An annular groove 218 on the outer peripheral surface of piston portion 102 is connected to radially inwardly extending passages 220, 222 intersecting a central bore 224 which slidably reciprocably supports valve spool member 126. Groove 218 is sufficiently wide to be connected to passage 214 in any position of the piston means 102 so that there is a continuous supply of wet glycol to passages 220, 222. Flow of wet glycol from passages 220, 222 into central bore 224 is controlled by a central annular valve portion 226 on spool valve member 126. Valve portion 226 has an axial width greater than the diameter of passages 220, 222 so as to close those passages in a central position of the valve spool member as illustrated in FIG. 1. Portions of the valve spool member on adjacent opposite sides of valve portion 226 are reduced in diameter to provide elongated axially extending equal length annular passages 228, 230 terminated by annular valve portions 232, 234 which separate passages 228, 230 from reduced diameter annular passages 236, 238 connected by radial passages 240, 242 to an axially extending outlet passage 244 in spool member 126. Bore 224 has a pair of radially outwardly extending elongated axially extending passages 246, 248 located opposite valve spool valve portions 232, 234 for connecting passages 228, 230 to passages 240, 242 when valve portions 232, 234 are centered relative to passages 246, 248. Passages 246, 248 may be drilled and closed by threaded plug members 249. Passages 228, 230 are connected to motor chambers 118, 120 by radially extending drilled passages 250, 252 having plugs 253 at the outer ends and intersecting elongated axially extending passages 254, 255. The piston end surfaces 256, 257 have annular cavities 258, 259. Stop collars 262, 264 are fastened to the spool member by retainer ring members 265 and have abutment surfaces 266, 268 engageable with surfaces 270, 272 of piston end portions 104, 106 in cavities 258, 259. Valve spool member 126 is slidably sealed by suitable sealing means 274, 276, 278, FIG. 1. Piston portions 102, 104, 106 are sealed by suitable sealing rings 280, 282, 284, 286, FIG. 1, so that chambers 114, 116, 118, 120 are essentially sealed against fluid leakage between the piston portions and the cylinder walls.

The Pump Regulator and Secondary Motor Section

Figure 2:
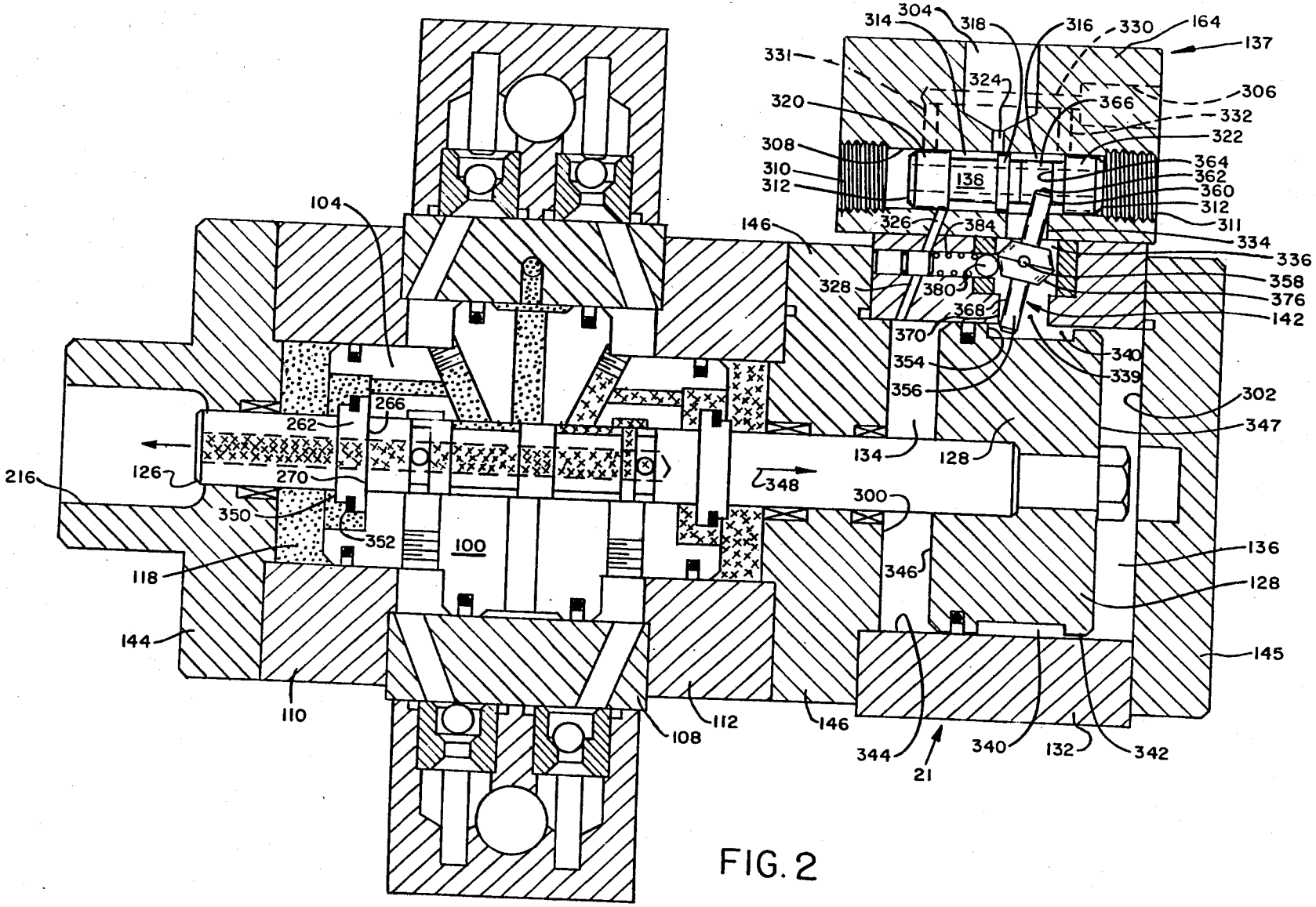
FIG. 2 is a cross-sectional side elevational view of the apparatus of FIG. 1 with piston parts located in a rightward shifted position at the end of a first pumping stroke.
Figure 4:
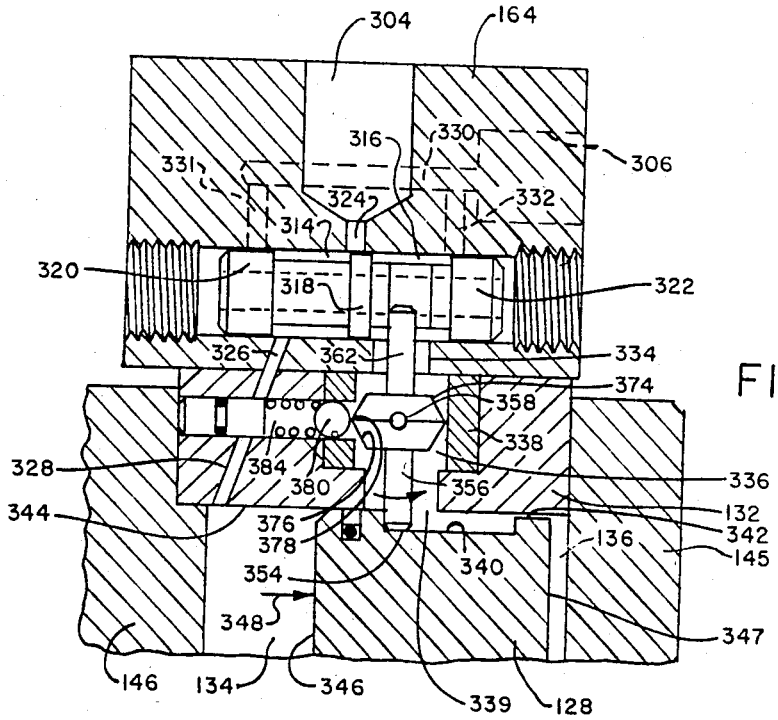
FIGS. 4 and 5 are enlarged cross-sectional side elevational views of the gas operated regulating portion of the apparatus of FIG. 1.
Figure 5:
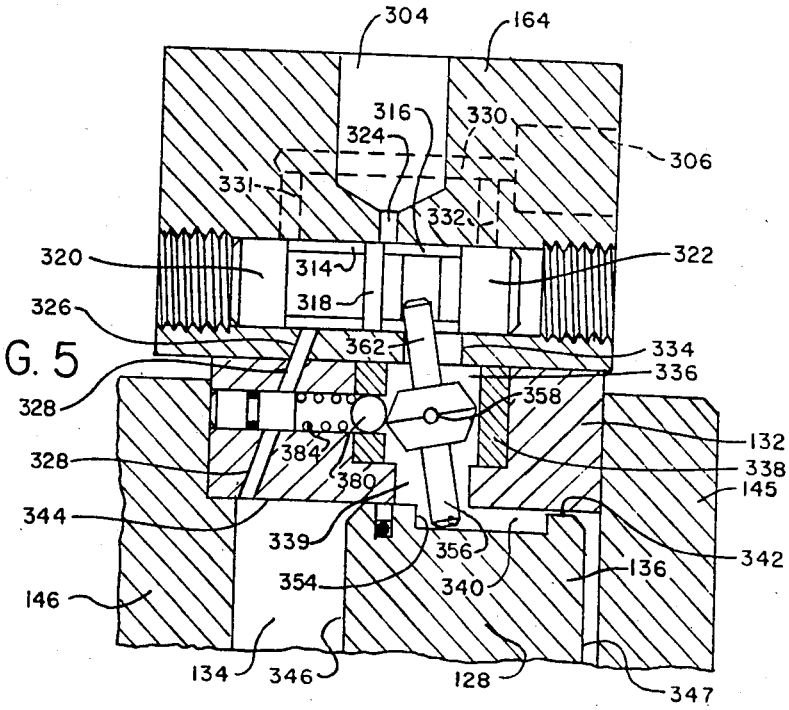

Referring to FIGS. 2, 4 and 5, the position of motor control valve spool member 126 relative to motor-pump piston means 100 is controlled by the position of regulator piston means 128 which is reciprocably movable between end walls 300, 302 of chambers 134, 136 by pressurized dry gas alternately received and exhausted from dry gas inlet and outlet ports 304, 306. The flow of dry gas to and from chambers 134, 136 is controlled by spool valve means 138 which is reciprocably movable in a bore 308 in valve block 164, closed by plug members 310, 311, between oppositely displaced control positions whereat the end surfaces 312, 313 abut the adjacent ends of the plugs. Valve means 138 is positively alternately located in one or the other of the control positions by a snap acting toggle type control means 142 operatively associated with the regulator piston 128. Spool valve means 138 comprises a pair of elongated reduced diameter fluid passage portions 314, 316 located between a central annular valve portion 318 and end valve portions 320, 322. When spool valve 138 is located in a rightwardmost position as shown in FIG. 2, gas inlet 304 is connected to chamber 134 through passage 324 in valve block 164, spool passage 314 and radially extending passages 326 in valve block 164 and 328 in cylinder member 132. Exhaust port 306 is connected to chamber 136 through passages 330, 332 in valve block 164, spool passage 316, passage 334 in valve block 164, passage 336 in an insert member 338 in cylinder member 132, a passage 339 in cylinder member 132, an annular peripheral groove 340 in the periphery of piston member 128, and a clearance gap 342 between the piston member 128 and cylinder inner surface 344. Thus, the pressurized dry gas exerts a force on piston surface 346 in the direction of arrow 348 and causes movement of the piston and motor spool valve 126 in the direction of the arrow 348 while the motor-pump piston means 100 is being driven in the same direction by force being exerted on motor piston portion 104 by wet glycol in motor chamber 118. At this time, abutment surface 266 on collar 262 attached to spool 126 may engage with motor piston surface 270 so that the wet glycol in motor chamber 118 also exerts force on collar surfaces 350, 352 to assist in movement of piston 100 in the direction of arrow 348. During the movement of regulator piston 128 to the right, side surface 354 of groove 340 engages a pin 356 of toggle means 142 and causes movement thereof about a pivotal connection 358 from the position of FIG. 2 toward the position of FIG. 4. Toggle means 142 is pivotally mounted in passage 336 on insert 338 by pivotal connecting means 358 for pivotal movement between the position of FIG. 2, whereat a side surface 360 of a pin 362 engages a side surface 364 of a slot 366 in spool member 138 and a side surface 368 of pin 356 engages a side surface 370 of passage 339 in cylinder member 132. As shown in FIG. 1, toggle means 142 has a central body portion 372 with conical shape surfaces 374, 376 intersecting at 378 in a plane including the axis of pivotal connecting means 358. A ball detent member 380 is mounted in a bore 382 in insert 338 aligned with the pivotal axis of pivotal connecting means 358. A compression spring member 384 is mounted in a bore 386 in cylinder member 132 opposite bore 382 to resiliently bias the ball 380 into engagement with central body portion 372. A plug member 388 holds the spring 384 in the bore 386. In the position of FIG. 2, the ball 380 engages conical surface 376. As the regulator piston 128 moves to the right between the positions of FIGS. 2 and 4, the conical surface 376 moves relative to the ball until the ball 380 is located on the intersection 378 of surfaces 374, 376 as shown in FIG. 4. During this movement, the ball 380 is moved rearwardly against and compresses the spring 384. Then, as shown in FIG. 5, further movement of piston 128 moves toggle link means 142 over center relative to the ball and the spring 384 quickly forces the toggle link to the position of FIG. 5 whereat spool valve 138 is fully shifted to the left. Then chamber 136 is connected to gas intake port 304 through passages 324, 316, 334, 336, 339, 340 and 342. Chamber 134 is connected to gas exhaust port 306 through passages 330, 331, 314, 326 and 328. Piston 128 is moved to the left toward the position of FIG. 2 which causes spool valve 126 to be moved relative to piston means 100. If enough energy (a function of pressure and pump speed) is available from the wet glycol, the piston 100 will move to the left as soon as land 226 of spool valve 126 opens the port of passages 220, 222 and allows wet glycol to flow to chamber 120, FIG. 3. Piston means 100 will follow the movement of spool valve 126 and the opening between land 226 of spool valve 126 and passages 220, 222 will automatically open or close as required to keep the same speed at spool valve 126 and piston means 100. If enough energy is not available from the wet glycol, the spool valve 126 will move to the left completely opening the port between land 226 of spool valve 126 and the passages 220, 222 of piston 100 allowing a full flow of wet glycol to chamber 120 and the collar 264 will engage the surface 272 of motor piston portion 106 as shown in FIGS. 3 and 6 and the dry gas energy supplied by the pressure in chamber 136 will provide the additional necessary force to cause piston 100 to complete the pumping stroke. At this time, chamber 120 is connected to wet glycol intake port 80 through passages 214, 218, 220, 230, 252 and 255. Chamber 118 is connected to wet glycol exhaust port 216 through passages 244, 240, 236, 246, 228, 250 and 254. Thus, the direction of movement of pump-motor piston means 100 is reversed. The rate of movement of the regulator piston 128 is controlled by an adjustable throttle valve means 97, FIG. 1, in dry gas exhaust line 96 which controls the rate of flow of dry gas from chambers 134, 136. In this manner, the rate of movement of motor-pump piston means 100 is also controlled by the rate of movement of spool valve 126 attached to the regulator piston 128.

As indicated above, the dry gas also provides a source of energy, effective through the regulator piston 128, spool valve 126, and abutment collars 262, 264, for driving motor-pump piston means 100 whenever the energy available from the wet glycol is less than the energy required by the pump. Thus, the regulator section of the apparatus also provides a secondary motor means which is effective to prevent pump stalling and enable continuous operation throughout wide ranges of pressure conditions and operational speeds.

Modifications

Figure 7A:
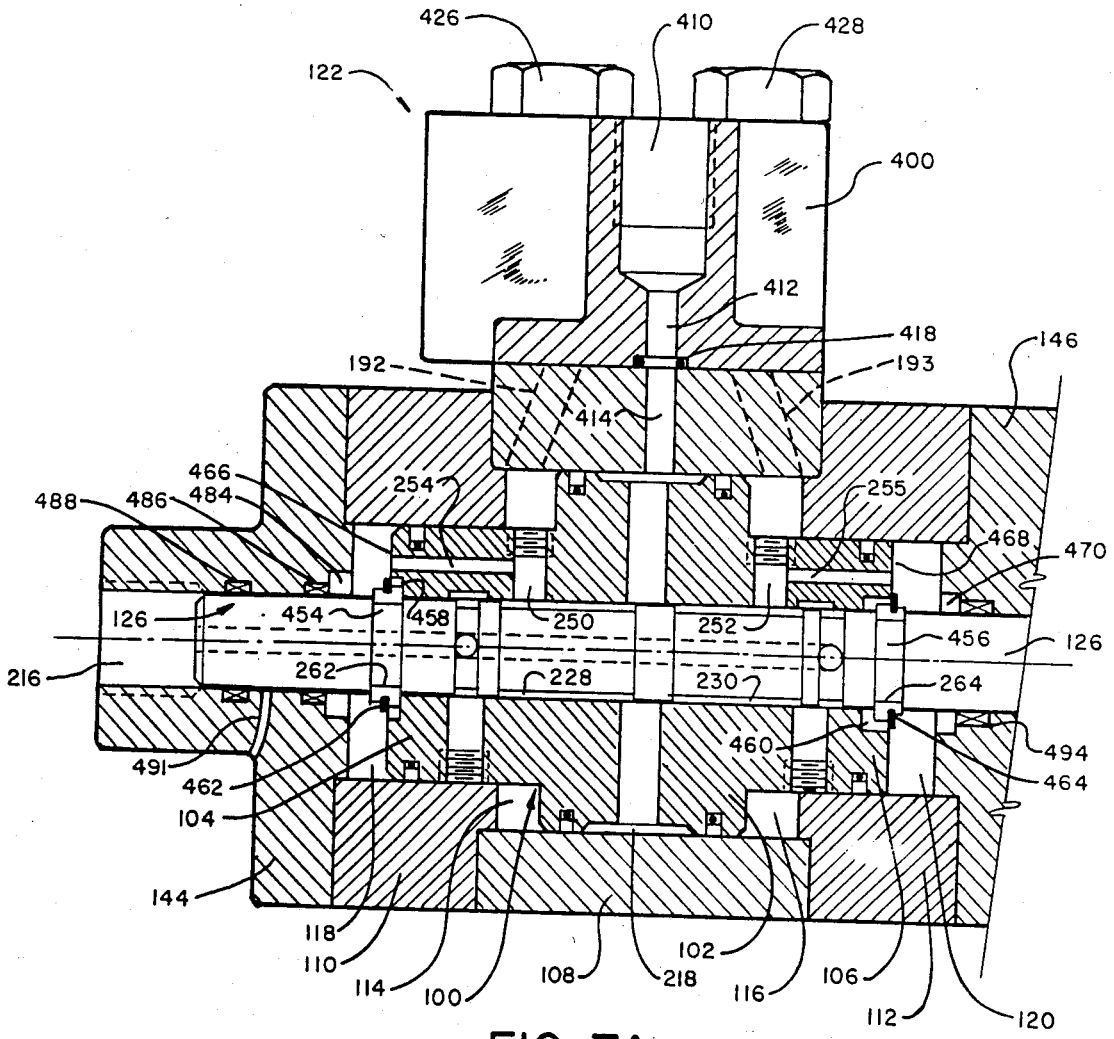
FIGS. 7A and 7B are cross-sectional side elevational views of a presently preferred embodiment of the invention with the piston parts shown in a center position.
Figure 7B:
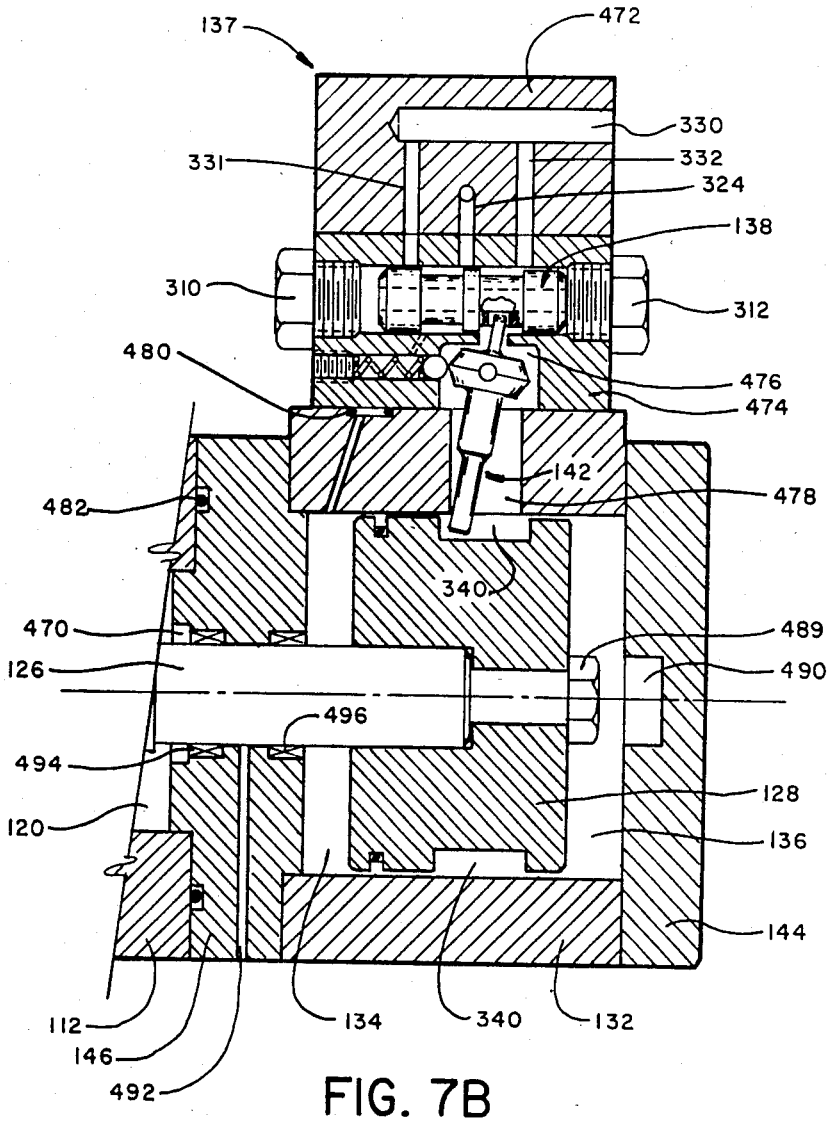
Figure 8:
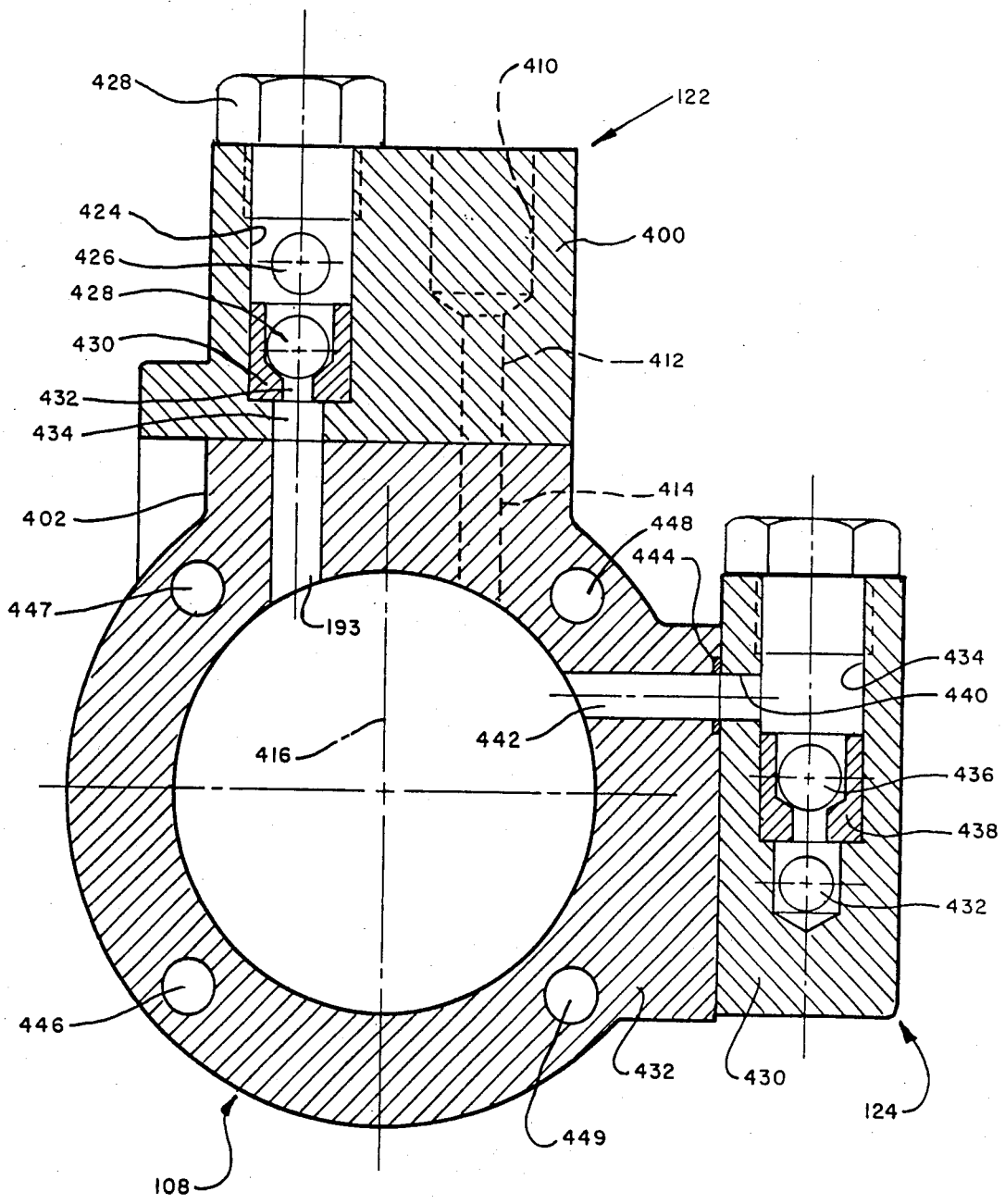
FIG. 8 is a cross-sectional view, with parts removed, of valving apparatus associated with the pump and motor portions of the apparatus.
Figure 9:
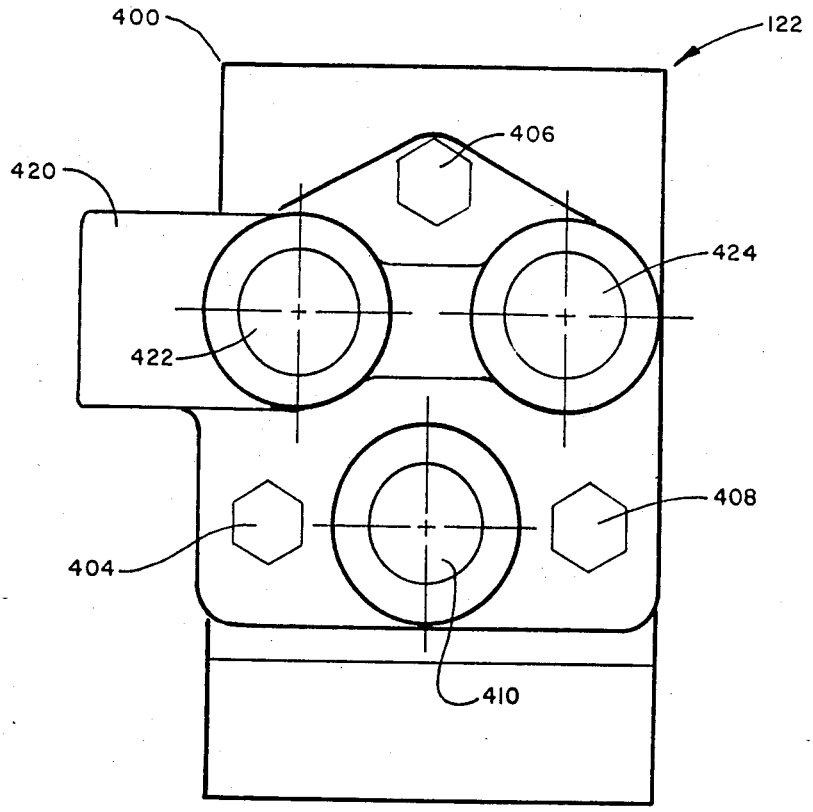
FIG. 9 is a plan view of the valving apparatus of FIG. 8.

The performance of the apparatus of FIGS. 1–6 may be substantially improved by use of the modifications shown in FIGS. 7–9 wherein like numerals have been used for like parts. The inlet and outlet valve means 122, 124 are differently arranged and constructed.

Valve means 122 comprises a block member 400 which is fastened on an upwardly projecting portion 402, FIG. 8, of cylinder means 108 by bolt members 404, 406, 408, FIG. 9. A vertically extending wet glycol inlet port 410, FIG. 7A, is connected to aligned vertical passages 412, 414 which are offset to one side of vertical center line 416, FIG. 8, and have a sealing ring 418, FIG. 7A, therebetween. A horizontally extending dry glycol outlet port 420, FIG. 9, is connected to vertically extending dry glycol exhaust passage means in spaced bores 422, 424 located on the opposite side of center line 416 and connected by a transverse bore 426, FIG. 8. Each passage means contains a ball valve 428 and a valve seat insert 430 having a passage 432 aligned with a passage 434 in block 400 and passages 192, 193 in cylinder member 108. The upper ends of bores 422, 424 are closed by threaded plug members 426, 428, FIG. 7A.

Dry glycol inlet valve means 124, FIG. 8, comprises a block member 430 which is fastened on a laterally horizontally extending mounting plate portion 432 of cylinder means 108 by suitable bolt members (not shown). A horizontally extending inlet passage 433 is connected to a pair of spaced vertically extending passage means in spaced vertically extending bores 434. Each passage means contains a ball valve 436 and a valve seat insert 438 with a laterally extending passage 440 aligned with a horizontally extending passage 442 in cylinder means 108 and having a sealing ring 444 therebetween. Passages 442 are similar in construction and function to passages 170, 172 of the first embodiment. FIG. 8 also shows bolt holes 446, 447, 488, 449 by which the cylindrical means, divider plate and end plates are secured to one another.

An advantage of the foregoing construction and arrangement is that the flow paths of the fluids are improved and possible gas and vapor locking of the pistons is reduced.

Referring now to FIG. 7A, the construction and arrangement of the piston means 100 and the spool valve means 126 also have been improved in the following manner. The inclined passages 250, 252 of FIG. 1 have been made vertical and the length of groove passages 228, 230 on spool valve member 126 have been lengthened. This arrangement facilitates manufacture Collars 262, 265 of FIG. 3 are mounted in grooves 454, 456 in spool valve 126 and are located within smaller diameter annular cavities 458, 460 in piston portions 104, 106 so that retainer rings 462, 464 are located closely adjacent the peripheral surfaces of cavities 458, 460. Cavity 460 is of greater axial length than cavity 458 and a cavity 470 has been provided in center plate 146 to receive collar 264. One of the reasons for these changes are to facilitate manufacture and assembly. Another and more important reason is to increase volumetric efficiency. The wet glycol is actually a liquid and gas mixture whose characteristics are substantially different than only a liquid. Thus, it is important to reduce end clearances and dead volumes to decrease gas consumption.

The construction and arrangement of the regulator valve means 137, FIG. 7B, has also been improved by making valve block 164 of FIG. 1 in separate pieces 472, 474 and mounting toggle means 142 in a cavity 476 in piece 474 above a cylindrical bore 478 in cylinder member 132.

It is to be understood that all abutment surfaces between adjacent fixed ports of the apparatus are suitably sealed by O-rings of the type shown at 480 and 482 by way of example in FIG. 7B. Additional improvements shown in FIG. 7A include the provision of an annular cavity 484 in end plate 144 to receive collar 262, and a pair of axially spaced sealing rings 486, 488, more adequately sealing the motor chamber 118. The axial length (i.e. depth) of cavities 458, 460 are sufficiently different to enable mounting of collars 262, 264 and the axial length of cavities 470, 484 are reversely variable to enable end surfaces 466, 468 of piston portions to closely approach the side surfaces of end plates 144, 146 while bolt head 489 is accommodated by a recess 490 in end plate 144 for the same purpose. In addition, a vertically extending weep passage 491 is provided between sealing bearings 486, 488 so that leakage of wet glycol along spool member 126 past bearing 486 may be immediately detected to enable repairs to be made. Additional improvements shown in FIG. 7B include a similar vertically extending weep passage 492 located between sealing bearings 494, 496 for a similar purpose.

OPERATING PARAMETERS

Ideally, approximately 2000 BTU are required to regenerate a gallon of glycol. In the dehydration process, 3 to 6 gallons of glycol is circulated per pound of water removed. The circulation rate is controlled to save energy. The dry glycol is at atmospheric pressure and boosted to line pressure, e.g. approximately 500 psi, which is the pressure of the wet glycol returned to the motor section 19 and then returned to atmospheric pressure It is preferable that the effective motor piston areas be substantially larger, e.g. 5 to 15%, than the effective areas of the pump piston so that no level controller is necessary in the wet glycol sump since more fluid will be metered out by the motor piston portions than is pumped by the pump piston portions.

For operation, the dry gas motor, under the influence of a small amount (e.g. 0.5 to 2.0 cubic feet per gallon of pumped dry glycol) of pressurized gas, moves the gas piston one direction or the other, depending on the position of the toggle. The piston moves the attached push rod-valve of the liquid motor, so that the piston reciprocates in the motor. Since the pump piston is integral with the motor piston, it reciprocates in a dual pumping action for dry glycol. The gas rate to the gas motor controls the stroke rate of the liquid motor and therefore the pumping rate. The control gas is normally at a pressure of 20 to 100 psi, and the stroke rate is controlled by a needle valve 97 mounted in the gas outlet line as shown in FIG. 1, or alternatively mounted in the gas inlet line 94. As shown in FIG. 4, the toggle has free pivotal travel in the gas motor valve, the toggle achieves a vertical or center position, but the gas valve does not. The toggle continues travel in either direction so as to cause the toggle to snap to full left or right position, due to the bias of the ball detent, thereby causing the gas valve to alternately shift to a left or right position, as heretofore described.

The mathematic basis for the system is set out below:

Let:

Am = liquid motor piston area
Ap = liquid pump piston area
Ag = gas piston area
Pa = absorber pressure and dry gas pressure
Pr = reboiler pressure
Pgs = gas motor supply pressure
Pge = gas motor exhaust pressure A force balance is:

$$Ap\,(Pa-Pr)=Am(Pa-Pr)+Ag\,(Pgs-Pge)-Ff$$

or $$Ap\cdot\Delta Pe=A\cdot\Delta Pe+Ag\cdot\Delta Pg-Ff$$

Where $Pe=Pa-Pr$ and $\Delta Pq=Pgs-Pge$

Ff is force necessary to overcome all friction.

Ff is generally of the form:

$$Ff=Fo+C_1\cdot\Delta Pe+C_2\cdot\Delta Pg+C_3\cdot S^2$$

Where $C_1$, $C_2$ and $C_3$ are constants and S is the stroke rate in cycles per minute.

To eliminate the need for a level controller in the absorber tower, slightly more fluid (wet glycol plus liquid hydrocarbons and/or entrained gas) must be metered out of the absorber by the liquid motor than is pumped into the absorber by the liquid pump. Therefore, the ratio Am/Ap must be greater than unity. The usual water pickup in the absorber is about 3% by volume of the circulated glycol, and the hydrocarbon pickup varies.

One particular prototype pump had the following specifications:

Ap=3.0925 square inches

Am=3.534 square inches

Ag=7.069 square inches and (Am/Ap)=1.143.

From emperical data, constants have been determined, using the above area ratio, in the force balance equation, giving:

$$(Am-Ap)\cdot\Delta Pe+Ag\cdot\Delta Pg=29.0+0.33\cdot\Delta Pe+0.012S^2$$

(the term $C_2$ Apg is negligible).

Using the above values:

$$0.1118\cdot\Delta Pe+7.069\cdot\Delta Pg=29.0+0.012S^2$$

for which the required gas motor differential pressure can be predicted for a given absorber pressure (approximately equal to Pe) and the stroke rate S for the example prototype pump.

The system is highly energy efficient with the driving and driven pistons being at times operable solely by energy which is an available byproduct of the dehydration system. The apparatus is self-controlled and self-driving in that the motor control valve spool is shifted automatically by the gas piston in operation of the system. Under normal high pressure operating conditions, e.g. approximately above 100 psi of the motor fluid, a fluid balanced system is provided with no pump driving energy being derived from the gas piston. Whenever the drive fluid pressure is less than approximately 100 psi, the gas piston is capable of providing energy to assist in operation of the drive piston. By using the exhaust gas from the gas motor in the burner on the reboiler, no saleable dry gas is wasted to the atmosphere.

The pumping system is essentially stallproof while having a reliability in operation at least equal to a conventional gas driven glycol pump and providing an energy saving in excess of a conventional glycol balance pump. The pump system has a much wider operating range, e.g. 10 to 120 strokes per minute, than prior art systems.

Since the system is self-modulating, the pump system precludes pump run-away which might be caused by loss of suction. The pump system is stallproof because of the snap action of the gas control system. The gas throttle valve enables control of the speed (rate of reciprocation) of the pump and motor pistons.

A first prototype pump constructed in accordance with FIGS. 1–6 had a liquid motor piston to liquid pump piston area ratio of 1.14 or, therefore, it had a 14 percent overbalance of liquid motor to liquid pump. The discharge and suction check blocks were mounted to the top and bottom, respectively, of the liquid cylinder. The toggle, toggle holder and ball were housed in the main gas cylinder. Test results showed:

Pump liquid end using 2.86 $ft^3$ per gallon at 358 psig.

Pump gas end using 1.50 $ft^3$ per gallon at 358 psig.

Initial tests of this first prototype produced gas consumption values higher than expected. Three possible causes of excessive gas consumption were determined to be:

(1) Excessive clearance and dead volumes at the end of the liquid motor piston.

(2) Excessive overbalance ratio (3) Improper filling of the liquid pump section because of improper check valve design.

The first prototype was modified to provide a 3 percent overbalance and testing again showed excessive gas consumption with no significant improvement in consumption because of the reduction in balance ratio. At this time it was felt that the clearance and dead volumes probably had a significant effect. The glycol and gas, representing the wet glycol, is really a mixture which discharges from the pump as a froth because the reduced pressure causes the gas to expand. Therefore, each discharge of the wet glycol motor section causes removal of most of the glycol from the clearance volume and dead volume. On the subsequent high pressure charging of the motor section, the clearance and dead volume must first be refilled with high pressure liquid (plus some high pressure gas) before stroking takes place. This causes the gas consumption (at working pressure) on the following stroke to be increased by approximately the amount of the clearance and dead volume.

The first prototype was again modified as illustrated in FIGS. 7–9 to reduce the clearance and dead volumes to a practical minimum. A retest showed significant gas consumption reduction as indicated by the following results:

Pump liquid end using 1.38 $ft^3$ per gallon at 375 psig.

Pump gas end using 2.09 $ft^3$ per gallon at 375 psig.

The present invention is a highly economical assembly for pumping glycol in a gas well treater, using very small amounts of natural gas, and using the gas to fire the burner of the reboiler, one which may be similar to that shown in U.S. Pat. No. 3,541,763 to Heath dated Nov. 24, 1970. However, other systems may effectively use the unit.

One of the problems with dehydration is when gas flow drops to zero as a result of high line pressure, stopcocking, line freezes, etc. During the no flow conditions energy is being consumed by the pump to circulate glycol as well as by the burner to heat the circulating glycol. Since there is no gas to glycol heat exchange, the glycol and containment vessels can reach elevated temperatures. This results in premature pump and packing failures as well as loss of glycol through the still column and when gas flow is reestablished it may take several hours for the unit to cool off enough to operate efficiently.

These problems can be avoided by installing a pump shutdown control device 500 on the gas production meter (usually an orifice type meter) 502 to shut down the glycol pump which would stop glycol circulation. The device 500 is movable between open and closed positions by the orifice meter and is operably connected by suitable connecting means 503 to a shut off valve 504 in the gas supply line 94 to pump regulator 21. To be most effective on pump shut down, use of a passive heating system on the separator as described in U.S. Pat. No. 4,198,214 is desirable.

Thus, another desirable and unique feature of the present invention is that the pump may be readily stopped and restarted by control of the supply gas to the gas driven motor.

The present invention has been heretofore described in connection with a presently particularly preferred embodiment. However, various modifications may be apparent to those skilled in the art from this description. For example, it is apparent that the areas described herein as motor or drive areas may be designed as pumping areas, while those areas described as pumping areas may be designed as motor or drive areas. These and other modifications are intended to be within the scope of the appended claims except insofar as precluded by the prior art.

What is claimed is:

1. A fluid pumping system for use with a natural gas dehydrating system or the like having an absorber apparatus for removing water from wet natural gas to produce dry natural gas by use of a dessicant agent such as glycol, a glycol reboiler means for producing a source of dry glycol from wet glycol received from the absorber apparatus by heat obtained from burning of the natural gas, the system comprising:

a fluid pump means operatively connected between dry glycol source and the absorber means for pumping dry glycol from the dry glycol source to the absorber means;

a fluid operable primary motor means operatively connected to said pump means for actuating said pump means and having fluid inlet passage means for receiving wet glycol from said absorber and fluid outlet passage means for delivering wet glycol to said glycol reboiler means whereby energy derived from the wet glycol provides the primary motivating force for said motor means and said pump means; and a speed control means being operable by the dry natural gas and operatively associated with said pump means and said motor means for automatically regulating the speed thereof.

2. The invention as defined in claim 1 and wherein: said speed control means being a fluid operable device operatively connected to and operable by the pressure of the natural gas.

3. The invention as defined in claim 2 and wherein said fluid operable device is constructed and arranged to provide a secondary motor means for assisting said primary motor means in actuation of said fluid pump means whenever the energy available from the wet glycol is below a predetermined minimum value.

4. The invention as defined in claims 2 or 3 wherein said speed control means comprising:

a cylinder means having variable volume fluid chambers at opposite ends thereof for receiving and exhausing natural gas therewithin;

a piston means having opposite piston head surfaces thereon and being freely reciprocable slideably mounted in said cylinder means for reciprocable movement therewithin to alternately cause intake and exhaust of natural gas to and from said variable volume fluid chambers; and a gas flow control valve means for controlling intake and exhaust of natural gas to and from said variable volume fluid chambers.

5. The invention as defined in claim 4 and wherein said gas flow control valve means comprising:

a spool valve means reciprocably slideably mounted for movement between first and second axially displaced positions; and spool valve control means operatively connecting said spool valve means to said piston means for causing positive actuation of said valve control means.

6. The invention as defined in claim 5 and wherein said spool valve control means comprising:

a spool control member having one end portion operatively engageable with said spool valve means and the other end portion operatively engageable with said piston means;

pivotal support means connected to said spool control member for enabling pivotal movement thereof between oppositely maximumly displaced positions alternately positioning said spool valve means in operative relationship with said variable volume fluid chambers; and snap action means associated with said spool control member for positively locating said spool control member in said oppositely maximumly displaced positions.

7. The invention as defined in claims 2 or 3 wherein:

said fluid pump means comprising a first double acting piston means;

said primary motor means comprising a second double acting piston means; and the effective areas of said second double acting piston means being substantially greater than the effective areas of said first double acting piston means.

8. The invention as defined in claim 7 and wherein:

the effective area of said second double acting piston means being between 5% and 15% greater than the effective areas of said first double acting piston means.

9. The invention as defined in claim 8 and wherein:

said second double acting piston means and said first double acting piston means being constructed and arranged as a single piston unit.

10. The invention as defined in claim 9 and further comprising:

a flow control spool valve means for controlling flow to said second double acting piston means and being mounted within said single piston unit for reciprocable movement relative thereto and for reciprocable movement therewith.

11. The invention as defined in claim 10 and wherein:

said flow control spool valve means being operatively connected to said speed control means.

12. The invention as defined in claim 11 and wherein:

said speed control means comprising a double acting piston means.

13. A method of pumping dry glycol from a dry glycol source to a dehydration device of a natural gas dehydrating system comprising the steps of:

utilizing the energy of wet glycol from the dehydrater device to operate a pump means for pumping the dry glycol from the dry glycol source to the dehydrater device; and utilizing dry gas from the dehydrater device to control the rate of reciprocation of the pump means.

14. The method as defined in claim 13 and wherein said pump means is a double acting piston device operatively connected to a double acting motor piston device and further comprising:

utilizing a volume of wet glycol which is higher than the volume of dry glycol.

15. The method as defined in claim 14 and further comprising:

regulating the rate of reciprocation of the dry glycol pump means and the wet glycol motor means by controlling the rate of flow of dry gas through a double acting piston means of a gas operated pump regulator means operatively associated with said motor means.

16. The method as defined in claim 15 and further comprising:

utilizing the energy of the dry gas to assist the movement of said motor means when the energy of the wet glycol is decreased.

17. The method as defined in claim 16 and further comprising:

conveying high pressure dry gas from the separator to a low pressure dry gas reservoir through a pressure regulator and reducing the pressure of the high pressure dry gas to provide low pressure dry gas in the low pressure dry gas reservoir;

conveying high pressure dry gas to a pressure regulator and reducing the pressure of the high pressure dry gas to provide low pressure dry gas and conveying the low pressure dry gas to the intake port of the gas operated pump regulator means for operation thereof; and conveying low pressure dry gas from the exhaust port of the gas operated pump regulator means to the low pressure gas reservoir.

18. The method as defined in claim 17 and further comprising:

controlling the rate of flow of low pressure dry gas through the gas operated pump regulator means and thereby controlling the rate of speed of operation of the pump.

19. The method as defined in claim 17 and further comprising:

stopping the flow of low pressure dry gas to the gas operated pump regulator means whenever the rate of flow of high pressure dry gas from dehydration apparatus is below or above predetermined flow rates enabling efficient operation of the natural gas dehydrating system.

20. A method of energizing and controlling the rate of a pump apparatus for pumping dry glycol between a wet glycol reboiler means and a dehydrating means of a natural gas dehydrating system, wherein the dry glycol is used in the dehydrating means to remove water from wet natural gas to produce saleable dry gas and wet glycol, and the pump apparatus includes a pump motor means and a pump means and a gas operated pump regulator means, comprising the steps of:

conveying wet glycol from the dehydrating means to the pump motor means and from the pump motor means to the reboiler means and utilizing the energy of the wet glycol to operate the pump means;

conveying dry glycol from the reboiler means to the pump means and increasing the pressure of the dry glycol in the pump means and conveying dry glycol of increased pressure to the dehydrating means; and conveying dry gas from the dehydrating means to the gas operated pump regulator means and reducing the pressure of the dry gas before the dry gas enters the gas operated pump regulator means and utilizing the energy of the dry gas of reduced pressure to operate the gas operated regulator means and control the rate of operation of the pump motor means and the pump means.

21. The method as defined in claim 20 and further comprising the steps of:

regulating the rate of flow of the dry gas of reduced pressure through the gas operated pump regulator means and thereby regulating the rate of operation of the pump motor means and the pump means.

22. The method as defined in claim 21 and further comprising the step of:

utilizing the energy of the dry gas of reduced pressure in the gas operated pump regulator means and a secondary source of energy to assist in the operation of the pump motor means whenever the energy of the wet glycol in the pump motor means is insufficient to maintain a desired rate of operation of the pump apparatus.

23. The method as defined in claim 22 wherein the dehydrating system includes a gas burner means associated with the reboiler means to heat wet glycol therein to produce the dry glycol and further comprising the step of:

conveying the dry gas of reduced pressure from the gas operated pump regulator means to the gas burner means associated with the wet glycol reboiler means and utilizing the energy of the dry gas of reduced pressure to heat the wet glycol in the reboiler means to produce the dry glycol.

24. The method as defined in claim 20 wherein a flow meter means associated with the dehydrating system receives the saleable dry gas from the dehydrating means and includes apparatus operable in response to the pressure of the saleable dry gas to indicate the rate of flow of the saleable dry gas, and further comprising the step of:

terminating the flow of dry gas to the gas operated pump regulator means whenever the flow of dry gas through the meter means exceeds predetermined high and low flow rates whereat the operation of the dehydrating system is to be terminated.

* * * * *